United States Patent [19]

Tsuji et al.

[11] Patent Number: 4,948,775

[45] Date of Patent: Aug. 14, 1990

[54] HEAT-SENSITIVE RECORD MATERIAL

[75] Inventors: Takuji Tsuji, Sakai; Tomohiro Yanagida, Hyogo, both of Japan

[73] Assignee: Kanzaki Paper Manufacturing Co., Ltd., Tokyo, Japan

[21] Appl. No.: 232,794

[22] Filed: Aug. 16, 1988

[30] Foreign Application Priority Data

Aug. 24, 1987 [JP] Japan ..... 62-210802

[51] Int. Cl.[5] ..... B41M 5/18

[52] U.S. Cl. ..... 503/207; 427/152; 503/200; 503/226

[58] Field of Search ..... 428/913, 914, 484, 323, 428/327; 427/150–152; 503/200, 207, 226

[56] References Cited

U.S. PATENT DOCUMENTS

| | | | |
|---|---|---|---|
| 3,988,501 | 10/1976 | Knirsch et al. | 428/537 |
| 4,032,690 | 6/1977 | Kohmura et al. | 428/263 |
| 4,370,370 | 1/1983 | Iwata et al. | 428/913 |
| 4,554,566 | 11/1985 | Yoneda et al. | 428/327 |

FOREIGN PATENT DOCUMENTS

| | | | |
|---|---|---|---|
| 2130891 | 6/1987 | Japan | 428/913 |

*Primary Examiner*—Pamela R. Schwartz

*Attorney, Agent, or Firm*—Morgan & Finnegan

[57] ABSTRACT

A heat-sensitive record material has a protective layer on the recording layer which is formed on a base sheet and which comprises a color forming material and a color developing material in the state of that they are contacted by heating to produce color images. The protective layer comprises a water-soluble high polymer and a polyethylene wax having an average particle size of 3 to 10 μm. The protective layer comprising the granular polyethylene wax in an amount of 0.1 to 30 parts by weight per 100 parts by weight of the solid amount of the protective layer improves the property of the heat-sensitive record material, particularly the sliding property and the retainability of recorded images without accompanying either lowering the initial color density of recorded images or sticking.

4 Claims, No Drawings

HEAT-SENSITIVE RECORD MATERIAL

BACKGROUND OF THE INVENTION

This invention relates to a heat-sensitive record material and particularly to a heat-sensitive record material in which both of the sliding property and the retainability of recorded images are improved without accompanying either lowering the initial color density of recorded images or sticking.

There has been well known heat-sensitive record materials utilizing the colorforming reaction between a basic colorless chromogenic material and an electron accepting acidic reactant material, in which color images are produced by heating to contact with each other of the basic colorless chromogenic material and the electron accepting acidic reactant material. Recently, recording systems of the heat-sensitive record materials have been very rapidly developed so that the recording speed becomes higher and the recording machine becomes compact and energy saving.

Resultantly, the applied field has become very wide. The properties required for the heat-sensitive record materials are increased. Particularly, in the case of using recording machines which are energy saving, such as small facsimiles or small printers, it is required for the heat-sensitive record material to have high sensitivity and good sliding property. The "good sliding property" means that the heat-seisitive record material is smoothly passed through recording machines with low friction.

Further, general heat-sensitive record materials have such a disadvantage that, contacting the recording layer with fats and oils or a plastic film, color images are easily discolored or faded by the effect of fats and oils or the plasticizer comprised in the plastic film.

Accordingly, it has been strongly desired to provide a heat-sensitive record material which has good sliding property and which can produce color images having a high color density and being superior in color-retainability without discoloration or fading by the effect of fats and oils or a plasticizer.

It has been well known that a metal soap or a wax is added to the coating layer applied on general record materials to improve the sliding property. In he case of heat-sensitive record materials, there is described in Japanese Patent Publication No. 14531 of 1975, U.S. Pat. No. 3,988,501 and U.S. Pat. No. 4,032,690 that the sliding property is improved by adding waxes to the recording layer to reduce the frictional heat generated by rubbing, scratching and the like and to prevent unnecessary color developing, namely "color developing by scratching", in the recording layer.

However, in order to improve the sliding property enough to satisfy such recent requirement as described hereinbefore, it is necessary to use metal soaps or waxes in a very large amount so that the initial color density of recorded images is remarkably reduced and it can not be prevented to adhere smudges on the thermal head. With the use of some modifiers for improving the sliding property, there is accompanied the problem "sticking", that is, the thermal head sticking to the recording layer. Further, since the heat-sensitive recording layer is formed as the most outer layer, the product becomes a heat-sensitive record material very poor in the retainability of recorded images.

U.S. Pat. No. 4,554,566 discloses a heat-sensitive record material having a recording layer in which fine particles of a material selected from the group consisting of ethylene-$\alpha$-olefin copolymer, lower density polyethylene and ethylene-vinyl acetate copolymer, having an average particle size of 0.03 to 16 microns, are added within the range of 5 to 50% by weight. The heat-sensitive record material is poor in the retainability of recorded images.

On the other hand, U.S. Pat. No. 4,370,370 discloses forming a protective layer comprising a water-soluble polymer on the recording layer to improve the retainability of recorded images.

However, even though, in order to improve the sliding property of heat-sensitive record materials having a protective layer, waxes are added to the protective layer, there has not been obtained a heat-sensitive record material which has a good sliding property and is superior in both of the initial color density and the retainability of recorded images without sticking.

The object of the invention is to provide heat-sensitive record materials in which the problems such as adhering smudges to the thermal head and sticking are practically prevented and which are superior in sliding property, initial color density and retainability of the recorded images.

SUMMARY OF THE INVENTION

The heat-sensitive record materials according to the invention have a specific protective layer on the recording layer which is formed on a base sheet and comprises a color forming material and a color developing material in the state of that they are contacted by heating to produce color images. The protective layer comprises a water-soluble polymer in which particles of a polyethylene wax having an average particle size of 3 to 10 $\mu$m. The polyethylene was is comprised in an amount of 0.1 to 30 parts by weight per 100 parts by weight of solid amount of the protective layer.

DETAILED DESCRIPTION OF THE INVENTION

According to the invention, a heat-sensitive record material in which each of the sliding property, the initial color density and the retainability of recorded images is remarkably improved without accompanying troubles such as sticking and the adhesion of smudges to a thermal head can be obtained by adding a polyethylene wax in the state of such relatively large particles as having an average particle size of 3 to 10 $\mu$m to the protective layer.

In the case of using the polyethylene wax having an average particle size of less than 3 $\mu$m, it is necessary to add a large amount of the wax so that a desired sliding property can be obtained but the troubles such as sticking and the adhesion of smudges can not be prevented. On the other hand, in the case of using the polyethylene wax having an average particle size of more than 10 $\mu$m, a desired sliding property can be obtained by the quality of recorded images becomes lower. Accordingly, the polyethylene waxes used in the invention should have an average particle size of 3 to 10 $\mu$m, preferably 4 to 8 $\mu$m.

The used amount of the polyethylene wax in the invention may be generally controlled within the range of 0.1 to 30 parts by weight per 100 parts by weight of the solid amount of the protective layer. The preferable amount is 0.5 to 10 parts by weight, the more preferable amount is 0.5 to 5 parts by weight and the most preferable amount is 0.5 to 4 parts by weight.

When the amount of the polyethylene wax is less than 0.1 parts by weight, the desired advantages according to the invention can not be obtained. On the contrary, when the amount of the polyethylene wax is more than 30 parts by weight, there occur various problems such as very lowering the initial color density and the retainability of recorded images and making the adaptability to recording machines worse due to sticking, the adhesion of smudges and the like.

When the polyethylene wax is added within the range of 0.5 to 5 parts by weight, particularly 0.5 to 4 parts by weight, per 100 parts by weight of the solid amount of the protective layer, there can by obtained a heat-sensitive record material very superior in each of the initial color density of recorded images, the retainability of recorded images and the sliding property, and superior in the adaptability to recording machines without the troubles such as sticking, the adhesion of smudges and the like.

As water-soluble polymers used with a polyethylene wax having such specific average particle size as described above to form a protective layer according to the present invention, there are exemplified polyvinyl alcohols such as completely saponified (or partially saponified) polyvinyl alcohol, carboxyl group modified polyvinyl alcohol, acetoacetyl group modified polyvinyl alcohol and the like; cellulose derivatives such as hydroxyethyl cellulose, methylcellulose, carboxymethylcellulose and the like; starch derivatives such as oxidized starch, enzyme modified starch, cationic starch, esterified starch, etherified starch and the like; casein, sodium alginate, polyvinyl pyrrolidone, polyacrylamide, salts of styrene-maleic anhydride copolymer, polyurethane resins, urea resins, melamine resins, polyamide resins, epichlorohydrin modified polyamide resins and the like. These water-soluble polymers may be used in combination if neccesary, and further may be used with at least one of synthetic polymer emulsions such as styrene-butadiene copolymer emulsions, styrene-acrylic ester emulsions, polyacrylic ester emulsions and the like. Among these water-soluble polymers, acetoacetyl group modified polyvinyl alcohol is most preferably used, because it is very useful to improve the retainability of recorded images.

Further, if neccesary, pigments may be added to the protective layer to improve the printability and the like. Among the pigments, there are included inorganic pigments such as calcium carbonate, zinc oxide, aluminum oxide, titanium dioxide, silicon dioxide, aluminum hydroxide, barium sulfate, zinc sulfate, talc, kaolin, clay, calcined kaolin, colloidal silica and the like; and organic pigments such as styrene microballs, polyamide powder, urea resin filler, formaldehyde resin filler, raw starch particles and the like. The used amount is not particularly limited, but generally it is preferable to use the pigments within the range of 5 to 500 parts by weight per 100 parts by weight of the resinous component comprised as binders.

Additionaly, in the protective layer, there may be added various additives, for example, lubricants such as zinc stearate, calcium stearate, carnauba wax, paraffin wax, ester was and the like; surfactants (dispersing agents or wetting agents) such as sodium dioctylsulfosuccinate and the like; curing agents such as glyoxal, boric acid, dialdehyde starch, epoxy compounds and the like; antifoaming agents; coloring dyes; fluorescent dyes and the like.

The coating composition used to form the protective layer is generally prepared as an aqueous composition, mixing and dispersing, if necessary, with a mixer or pulverizer such as ball mill, attritor, roll mill and the like, and then applied on a heat-sensitive recording layer with a usual coater such as air-knife coater, rod-blade coater, pure-blade coater, short dwell coater, curtain coater and the like, and dried. The coating amount is not particurlarly limited, but generally controlled within the range of 0.1 to 20 g/m$^2$, preferably 0.5 to 10 g/m$^2$ on dry basis, because the coating amount becomes too large to reduce the recording sensitibity of the heat-sensitive record material.

The combination of color forming materials and color developing materials, which are comprised in the recording layer, is not particularly limited. Any combination can be used so far as color images are produced by heating to contact with each other of the color forming material and the color developing material. For example, there be exemplified a combination of colorless basic chromogenic materials and inorganic or organic acidic compounds, a combination of metal salts of higher fatty acids such as ferric stearate and phenols such as gallic acid, and a combination of diazonium compounds, coupling reagents and basic compounds. Among them, the combination of colorless basic chromogenic mterials and inorganic or organic acidic compounds is very useful to obtain the desired advantages of the invention and accordingly most preferably used.

Among the colorless chromogenic materials comprised in the record layer according to the present invention, there are exemplified triarylmethane compounds such as 3,3-bis(p-dimethylaminophenyl)-6-dimethylaminophtalide, 3,3-bis(p-dimethylaminophenyl)phthalide, 3-(p-dimethylaminophenyl)-3-(1,2-dimethylindone-3-yl)phthalide, 3-(p-dimethylaminophenyl)-3-(2-methylindole-3-yl)phthalide, 3,3-bis(1,2-dimethylindole-3-yl)-5-dimethylaminophthalide, 3,3-bis(1,2-dimethylindole-3-yl)-6-dimethylaminophthalide, 3,3-bis(9-ethylcarbozole-3-yl)-6-dimethylaminophthalide, 3,3-bis(2-phenylindole-3-yl)-6-dimethylaminophthalide, 3-p-dimethylaminophenyl-3-(1-methylpyrrole-3-yl)-6-dimethylaminophthalide and the like; diphenylmethane compounds such as 4,4'-bis-dimethylaminobenzhydryl benzyl ether, N-halophenyl-leucoauramine, N-2,4,5-trichlorophenyl-leucoauramine and the like; thiazine compounds such as benzoyl-leucomethylene blue, p-nitrobenzyl-leucomethylene blue and the like; spiro compounds such as 3-methyl-spiro-dinaphthopyran, 3-ethyl-spiro-dinaphthopyran, 3-phenyl-spiro-dinaphthopyran, 3-benzyl-spiro-dinaphthopyran, 3-methyl-naphtho-(6'-methoxybenzo)spiropyran, 3-propylspiro-dibenzopyran and the like; lactam compounds such as Rhodamine-B anilinolactam, Rhodamine(p-nitroanilino)lactam, Rhodamine(o-chloroanilino)lactam and the like; and fluoran compounds such as 3-dimethylamino-7-methoxyfluoran, 3-diethylamino-6-methoxyfluoran, 3-diethylamino-7-methoxyfluoran, 3-diethylamino-7-chlorofluoran, 3-diethylamino-6-methyl-7-chlorofluoran, 3-diethylamino-6,7-diethylfluoran, 3-(N-ethyl-p-toluidino)-7-methylfluoran, 3-diethylamino-7-(N-acetyl-N-methylamino)fluoran, 3-diethylamino-7-N-methylaminofluoran, 3-diethylamino-7-dibenzylaminofluoran, 3-diethylamino-7-(N-methyl-N-benzylamino)-fluoran, 3-diethylamino-7-(N-chloroethyl-N-methylamino)fluoran, 3-diethylamino-7-N-diethylaminofluoran, 3-(N-ethyl-p-toluidino)-6-methyl-7-phenylaminofluoran, 3-(N-ethyl-p-toluidino)-6-methyl- 7-(p-toluidino)fluoran, 3-diethylamino-6-methyl-7-phenylaminofluoran, 3-dibutylamino-6-methyl-7-phenylaminofluoran, 3-diethylamino-7-(2-carbomethoxy-phenylamino)fluoran, 3-(N-cyclohexyl-N-methylamino)-6-methyl-7-phenylaminofluoran, 3-pyrrolidino-6-methyl-7-phenylaminofluoran, 3-piperidino-6-methyl-7-phenylaminofluoran, 3-diethylamino-6-methyl-7-xylidinofluoran, 3-diethylamino-7-(o-chlorophenylamino)fluoran, 3-dibutylamino-7-(o-chlorophenylamino)fluoran, 3-pyrrodilino-6-methyl-7-p-butylphenylaminofluoran, 3-(N-methyl-N-n-amyl-)amino-6-methyl-7-phenylaminofluoran, 3-(N-ethyl-N-n-amyl)amino-6-methyl-7-phenylaminofluoran, 3-(N-ethyl-N-isoamyl)amino-6-methyl-7-phenylaminofluoran, 3-(N-methyl-N-n-hexyl)amino-6-methyl-7-phenylaminofluoran, 3-(N-ethyl-N-n-hexyl)amino-6-methyl-6-methyl-7-phenylaminofluoran, 3-(N-ethyl-N-β-ethylhexyl)amino-6-methyl-7-phenylaminofluoran and the like. These chromogenic materials may be used either solely or in combination.

Among the acidic compounds which develop a color by contacting with the above chromogenic materials, there are included inorganic compounds such as activated clay, acid clay, attapulgite, bentonite, colloidal silica, aluminum silicate and the like; organic acidic compounds such as phenolic compounds, e.g., 4-tert-butylphenol, α-naphthol, β-naphthol, 4-acetylphenol, 4-tert-octylphenol,4,4'-sec-butylidenediphenol, 4-phenylphenol, hydroquinone, 4,4'-dihydroxydiphenylmethane, 4,4'-isopropylidenediphenol, 2,2'-bis(4-hydroxyphenyl)-4-methylpentane, 4,4'-cyclohexylidenediphenol, 4,4'-dihydroxydiphenylsulfide, 4,4'-thiobis(6-tert-butyl-3-methylphenol), 4,4'-dihydroxydiphenylsulfone, 4-hydroxy-4'-methyldiphenylsulfone, 4-hydroxy-4'-methoxydiphenylsulfone, 4-hydroxy-4'-isopropoxydiphenylsulfone, hydroquinone monobenzyl ether, butyl bis(4-hydroxyphenyl)acetate, 4-hydroxybenzophenone, 2,4-dihydroxybenzophenone, 2,4,4'-trihydroxybenzophenone, 2,2',4,4'-tetrahydroxybenzophenone, 2,2'-methylenebis(4-chlorophenol), 1,3-di(2-(4-hydroxyphenyl)-2-propyl)benzene, bis(3-allyl-4-hydroxyphenyl)sulfone, dimethyl 4-hydroxyphthalate, methyl 4-hydroxybenzoate, ethyl 4-hydroxybenzoate, propyl 4-hydroxybenzoate, butyl 4-hydroxybenzoate, pentyl 4-hydroxybenzoate, phenyl 4-hydroxybenzoate, benzyl 4-hydroxybenzoate, tolyl 4-hydroxybenzoate, chlorophenyl 4-hydroxybenzoate, phenylpropyl 4-hydroxybenzoate, phenetyl 4-hydroxybenzoate, p-chlorobenzyl 4-hydroxybenzoate, p-methoxybenzyl 4-hydroxybenzoate, novolak phenol resin, phenol polymers and the like; aromatic carboxylic acids, e.g., benzoic acid, p-tert-butylbenzoic acid, trichlorobenzoic acid, terephthalic acid, 3-sec-butyl-4-hydroxybenzoic acid, 3-cyclohexyl-4-hydroxybenzoic acid, 3,5-dimethyl-4-hydroxybenzoic acid, salicylic acid, 3-isopropylsalicylic acid, 3-tert-butylsalicyclic acid, 3-benzylsalicyclic acid, 3-(α-methylbenzyl)salicyclic acid, 3-chloro-5-(α-methylbenzyl)salicyclic acid, 3,5-di-tert-butylsalicyclic acid, 3-phenyl-5-phenyl-5-(α,α-dimethylbenzyl)-salicyclic acid, 3,5-di-α-methylbenzylsalicyclic acid and the like; salts of the above phenolic compounds or aromatic carboxylic acids with polyvalent metals such as zinc, magnesium, aluminum, calcium, titanium, manganese, tin and nickel; and antipyrine complexes of zinc thiocyanate. These acidic compounds may be used either solely or in combination.

The ratio of the color forming materials and the color developing materials used in the present invention may be suitably selected depending on the kind of the color forming material and the color developing material, accordingly is not particularly limited. However, when basic chromogenic materials and acidic compounds are used, the amount of the acidic compounds is generally within the range of 1 to 50 parts by weight, preferably within the range of 1 to 10 parts by weight, per one part by weight of the chromogenic materials.

The method for forming the recording layer is not limited. It may be formed by applying a coating composition on a base sheet. The coating composition may be prepared by dispersing, simultaniously or separately, the color forming material and the color developing material in an aqueous medium with the use of a mixer or pulverizer such as ball mill, attritor, sand mill or the like.

The coating composition usually may comprise a binder in an amount of 10 to 70%, preferably 15 to 50% by weight on the basis of total solid amount. Among the useful binder materials there may be included starches, hydroxyethylcellulose, methylcellulose, carboxymethyl cellulose, gelatin, casein, gum arabic, polyvinyl alcohol, salts or diisobutylene-maleic anhydride copolymer, salts of styrene-maleic anhydride copolymer, salts of ethylene-acrylic acid copolymer, salts of styrene-acrylic acid copolymer, styrene-butadiene copolymer emulsions and the like.

The coating composition may include additives such as dispersing agents, e.g., sodium dioctylsulfosuccinate, sodium dodecylbenzenesulfonate, sodium lauryl sulfate, alginates and metal salts of fatty acids; ultraviolet ray absorbing agents, e.g., benzophenone compounds and triazole compounds; antifoaming agent; fluorescent dyes; coloring dyes and the like.

Further, in the coating composition, there may be added lubricants such as zinc stearate, calcium stearate, carnauba wax, paraffin wax and ester wax; and inorganic pigments such as kaolin, talc, calcium carbonate, calcined kaolin, titanium oxide, diatomaceous earth, finely divided anhydrous silica and activated clay.

Additionally, so far as the desired advantages obtained by the present invention are not prevented, there may be added as a sensitizer, fatty acid amides such as stearic acid amide, stearic acid methylenebisamide, oleic acid amide, palmitic acid amide, and coconut aliphatic acid amide; hindered phenoles such as 2,2'-methylenebis(4-methyl-6-tert-butylphenol), 4,4'-butylidenebis(6-tert-butyl-3-methylphenol) and 1,1,3-tris(2-methyl-4-hydroxy-5-tertbutylphenyl)butane; ethers such as 1,2-bis(phenoxy)ethane, 1,2-bis(4-methylphenoxy)ethane, 1,2-bis(3-methylphenoxy)ethane and 2-naphthol benzyl ether; esters such as dibenzyl terephthalate and phenyl 1-hydroxy-2-naphthoate; ultraviolet ray absorbing agent such as 2-(2'-hydroxy-5'-methylphenyl)benzotriazol and 2-hydroxy-4-benzyloxybenzophenone; various known heat-fusible materials such as p-benzylbiphenyl.

In order to form the recording layer according to the invention, there may be applied any conventional coating technique. For example, a coating composition is coated on a base sheet with an air-knife coater, a rod-blade coater, a pure-blade coater, a short dwell coater, a curtain coater or the like, and then dried. The amount of the applied coating composition is generally within 2 to 12 g/m$^2$, preferably 3 to 10 g/m$^2$ on dry basis.

As the base sheets, there are included paper, plastic films, synthetic paper and the like. Paper is most preferably used because of the cost and coating applicability.

Since thus obtained heat-sensitive record materials according to the present invention have a protective layer in which a specific amount of polyethylene wax having a specific average particle size is comprised, they are superior in anti-sticking property, anti-smudging property and sliding property, and further can develop good color images superior in color density and image-retainability.

If necessary, a resinous layer may be formed on the opposite surface of the base sheet to make the image-retainability more superior. Further there may be applied various known techniques in the manufacture of heat-sensitive recording materials, such as under-coating on the base sheet, coating an adhesive agent on the back of the recording material to produce adhesive labels, and the like.

PREFERRED EMBODIMENTS OF THE INVENTION

The following examples serve to illustrate the invention in more detail although the invention is not limited to the examples. Unless otherwise indicated, parts and % signify parts by weight and % by weight, respectively.

EXAMPLE 1

(1) Preparation of A liquid

The following composition was passed through a sand mill.

| | |
|---|---|
| 3-(N-cyclohexyl-N-methylamino)-6-methyl-7-phenylaminofluoran | 10 parts |
| 5% aqueous solution of methylcellulose | 20 parts |
| water | 10 parts |

Pulverization was continued until an average particle size of 3 μm.

(2) Preparation of B liquid

The following composition was passed through a sand mill.

| | |
|---|---|
| 4,4'-isopropylidenediphenol | 20 parts |
| 5% aqueous solution methylcellulose | 5 parts |
| water | 55 parts |

Pulverization was continued until an average particle size of 3 μm.

(3) Preparation of C liquid

The following composition was passed through a sand mill.

| | |
|---|---|
| 1,2-bis(3-methylphenoxy)ethane | 20 parts |
| 5% aqueous solution of methylcellulose | 5 parts |
| water | 55 parts |

Pulverization was continued until an average particle size of 3 μm.

(4) Making a heat-sensitive record material

The following composition was mixed to prepare a coating composition.

| | |
|---|---|
| A liquid | 40 parts |
| B liquid | 80 parts |
| C liquid | 80 parts |
| 20% aqueous solution of polyvinyl alcohol (PVA-105 manufactured by Kuraray Co., Ltd.) | 100 parts |

The coating composition was coated on a base paper sheet of 50 g/m$^2$ in the weight of an amount of 6 g/m$^2$ on dry basis and dried to obtain a heat-sensitive record material.

(5) Forming a protective layer

The following composition was mixed to prepare a protective coating composition.

| | |
|---|---|
| 10% aqueous solution of polyvinyl alcohol (PVA-110 manufactured by Kuraray Co., Ltd.) | 100 parts |
| calcium carbonate | 20 parts |
| 30% aqueous emulsion of polyethylene wax (average particle size: 7 μm) | 10 parts |
| water | 55 parts |

The protective coating composition was coated on the recording layer of the above heat-sensitive record material in the weight of an amount of 6 g/m$^2$ on dry basis and dried. The resultant material was super-calendered to obtain a heat-sensitive record material having a protective layer.

EXAMPLE 2

(1) Preparation of D liquid

The following composition was passed through a sand mill.

| | |
|---|---|
| 4-hydroxy-4'-isopropoxy-diphenylsulfone | 20 parts |
| 5% aqueous solution of methylcellulose | 5 parts |
| water | 55 parts |

Pulverization was continued until an average particle size of 3 μm.

(2) Making a heat-sensitive record material

A heat-sensitive record material was obtained in the same manner as in Example 1 except that the above D liquid was used instead of B liquid.

(3) Forming a protective layer

The same protective coating composition as in Example 1 was coated on the recording layer of the above heat-sensitive record material in the weight of an amount of 6 g/m$^2$ on dry basis and dried. The resultant material was super-calendered to obtain a heat-sensitive record material having a protective layer.

EXAMPLE 3

A heat-sensitive record material having a protective layer was obtained in the same manner as in Example 2 except that the amount of 30% aqueous emulsion of polyethylene wax (average particle size: 7 μm) used to prepare the protective coating composition was 2 parts.

EXAMPLE 4

A heat-sensitive record material having a protective layer was obtained in the same manner as in Example 2 except that the amount of 30% aqueous emulsion of polyethylene wax (average particle size: 7μm) used to prepare the protective coating composition was one part.

EXAMPLE 5

A heat-sensitive record material having a protective layer was obtained in the same manner as in Example 2 except that the amount of 30% aqueous emulsion of polyethylene wax (average particle size: 7 μm) used to prepare the protective coating composition was 4 parts.

EXAMPLE 6

A heat-sensitive record material having a protective layer was obtained in the same manner as in Example 2 except that the average particel size of polyethylene wax used to prepare the protective coating composition was 5 μm.

EXAMPLE 7

A heat-sensitive record material having a protective layer was obtained in the same manner as in Example 6 except that the amount of 30% aqueous emulsion of polyethylene wax (average particle size: 5 μm) used to prepare the protective coating composition was 2 parts.

EXAMPLE 8

(1) Preparation of E liquid

The following composition was passed through a sand mill.

| | |
|---|---|
| 1,2-bis(phenoxy)ethane | 20 parts |
| 5% aqueous solution of methylcellulose | 5 parts |
| water | 55 parts |

Pulverization was continued until an average particle size of 3 μm.

(2) Making a heat-sensitive record material

The following composition was mixed to prepare a coating composition.

| | |
|---|---|
| A liquid | 40 parts |
| D liquid | 80 parts |
| E liquid | 80 parts |
| 20% aqueous solution of polyvinyl alcohol (PVA-105 manufactured by Kuraray Co., Ltd.) | 100 parts |

The coating composition was coated on a base paper sheet of 50 g/m$^2$ in the weight of an amount of 6 g/m$^2$ on dry basis and dried to obtain a heat-sensitive record material.

(3) Forming a protective layer

The same protective coating composition as in Example 5 was coated on the recording layer of the above heat-sensitive record material in the weight of an amount of 6 g/m$^2$ on dry basis and dried. The resultant material was super-calendered to obtain a heat-sensitive record material having a protective layer.

EXAMPLE 9

(1) Preparation of F liquid

The following composition was passed through a sand mill.

| | |
|---|---|
| 2,2-bis(4-hydroxyphenyl)-4-methylpentane | 20 parts |
| 5% aqueous solution of methylcellulose | 5 parts |
| water | 55 parts |

Pulverization was continued until an average particle size of 3 μm.

(2) Making a heat-sensitive record material

The following composition was mixed to prepare a coating composition.

| | |
|---|---|
| A liquid | 40 parts |
| E liquid | 80 parts |
| F liquid | 80 parts |
| 20% aqueous solution of polyvinyl alcohol (PVA-105 manufactured by Kuraray Co., Ltd.) | 100 parts |

The coating composition was coated on a base paper sheet of 50 g/m$^2$ in the weight of an amount 6 g/m$^2$ on dry basis and dried to obtain a heat-sensitive record material.

(3) Forming a protective layer

The same protective coating composition as in Example 5 was coated on the recording layer of the above heat-sensitive record material in the weight of an amount of 6 g/m$^2$ on dry basis and dried. The resultant material was super-calendered to obtain a heat-sensitive record material having a protective layer.

CONTROL 1

A heat-sensitive record material having a protective layer was prepared in the same manner as in Example 1 except that 30% aqueous emulsion of zinc stearate (average particle size; 3 μm) was used instead of 30% aqueous emulsion of polyethylene wax (average particle size: 7 μm) to produce the protective coating composition.

CONTROL 2

A heat-sensitive record material having a protective layer was prepared in the same manner as in Example 2 except that 30% aqueous emulsion of zinc stearate (average particle size; 3 μm) was used instead of 30% aqueous emulsion of polyethylene wax (average particle size: 7 μm) to produce the protective coating composition.

CONTROL 3 TO 6

Four heat-sensitive record materials having a protective layer were prepared in the same manner as in Example 2 except that each of 30% aqueous emulsion of stearic acid amide having an average particle size of 7 μm (Control 3), 30% aqueous emulsion of ethylenebis-stearic acid amide having an average particle size of 4 μm (Control 4), 30% aqueous emulsion of paraffin wax having an average particle size of 1.7 μm (Control 5) and 30% aqueous emulsion of micro wax having an average particle size of 6.5 μm (Control 6) was used instead of 30% aqueous emulsion of polyethylene wax having an average particle size of 7 μm to produce the protective coating composition.

CONTROL 7

A heat-sensitive record material having a protective layer was prepared in the same manner as in Example 2 except that 30% aqueous emulsion of polyethylene wax having an average particle size of 2.5 μm was used instead of 30% aqueous emulsion of polyethylene wax having an average particle size of 7 μm to produce the protective coating composition.

CONTROL 8

A heat-sensitive record material having a protective layer was prepared in the same manner as in Example 2 except that 30% aqueous emulsion of polyethylene wax having an average particle size of 0.5 μm was used instead of 30% aqueous emulsion of polyethylene wax having an average particle size of 7 μm to produce the protective coating composition.

CONTROL 9

A heat-sensitive record material having a protective layer was prepared in the same manner as in Example 2 except that 50 parts of 30% aqueous emulsion of polyethylene wax having an average particle size of 2.5 μm as used instead of 10 parts of 30% aqueous emulsion of polyethylene wax having an average particle size of 7 μm to produce the protective coating composition.

CONTROL 10

A heat-sensitive record material having a protective layer was prepared in the same manner as in Example 2 except that the amount of 30% aqueous emulsion of polyethylene wax having an average particle size of 7 μm used to produce the protective coating composition was 0.02 parts.

The properties of thus obtained nineteen heat-sensitive record materials having a protective layer were examined by the following methods. The results are shown in Table 1.

INITIAL COLOR DENSITY

Each of thus obtained nineteen heat-sensitive record materials having a protective layer is recorded by a thermal facsimile HIFAX-700 manufactured by Hitachi Ltd. to develop a color image. The optical density of the color image is measured by Macbeth densitometer RD-100R manufactured by Macbeth Corp.

SLIDING PROPERTY

A heat-sensitive record material was attached on a movable plate, in which a flat metal surface is covered with an urethane mat, in the manner as the protective layer is exposed outward. On the other hand, the same heat-sensitive record material is attached on a fixed weight having a weight of 200 g and a bottom area of 63 mm×63 mm in the manner as the protective layer is exposed outward. The fixed weight is put on the movable plate so that the heat-sensitive record material on the movable plate is contacted with the heat-sensitive record material on the fixed weight. Further, a weight of 200 g is put on the fixed weight, a side of the fixed weight is connected to a load sensor with a metal wire, and then the movable plate is moved in a constant speed of 16 cm/min in the direction opposite to the load sensor.

Moving the movable plate, the initial load value indicated in the load sensor is measured and the initial load value is divided by 400 (g). The resultant value is shown as the coefficient of static friction.

Further, continuously moving the movable plate, the load value is measured when the movable plate is moved between 5 cm and 10 cm from the starting point. The average load value is divided 400 (g). The resultant value is shown as the coefficient of dynamic friction.

ANTI-STICKING

When the heat-sensitive record material is recorded by a thermal facsimile HIFAX-700 manufactured by Hitachi Ltd., the sticking is observed and evaluated as follows.

O: Sticking is not appreciated.

X: Sticking is remarkably appreciated.

ANTI-PLASTICIZER

A polyvinyl chloride film manufactured by Mitsui Toatsu Chemicals, Inc. is wrapped threefold around a polypropylene pipe having a diameter of 40 mm. A heat-sensitive record material after color developing is put on the outer surface in the manner as the color images are exposed outward and further the same polyvinyl chloride film is wrapped threefold around the heat-sensitive record material. The resultant material is allowed to stand for 8 hours at 20° C. Anti-plasticizer is evaluated by the discoloration degree of the color images as follows;

◎ : Discoloration is not substantially appreciated.

○ : Discoloration is slightly appreciated but can be neglected

Δ: Discoloration is substantially appreciated so as to become a problem for practical use.

X: Discoloration is remarkably appreciated so as to make the practical use impossible.

OIL RESISTANCE

A few drops of cotton seed oil was droped on the color images of the heat-sensitive record material after color developing, allowed to stand for 8 hours and then wiped with a gauze. Oil resistance was evaluated by the discoloration degree of the color images. The evaluation is carried out in the same manner as in the above anti-plasticizer test.

TABLE 1

| | Initial color density | Sliding property: Coefficient of static friction | Sliding property: Coefficient of dynamic friction | Anti-sticking | Retainability of recorded images: Anti-plasticizer | Retainability of recorded images: Oil resistance |
|---|---|---|---|---|---|---|
| Example | | | | | | |
| 1 | 1.25 | 0.20 | 0.18 | ○ | ○ | ○ |
| 2 | 1.22 | 0.20 | 0.18 | ○ | ○ | ○ |
| 3 | 1.23 | 0.20 | 0.18 | ○ | ◎ | ◎ |
| 4 | 1.23 | 0.22 | 0.19 | ○ | ◎ | ◎ |
| 5 | 1.22 | 0.20 | 0.18 | ○ | ◎ | ◎ |
| 6 | 1.22 | 0.22 | 0.20 | ○ | ○ | ○ |
| 7 | 1.23 | 0.23 | 0.19 | ○ | ◎ | ◎ |
| 8 | 1.24 | 0.20 | 0.18 | ○ | ◎ | ◎ |
| 9 | 1.23 | 0.20 | 0.18 | ○ | ◎ | ◎ |
| Control | | | | | | |
| 1 | 1.24 | 0.47 | 0.30 | ○ | ○ | ○ |
| 2 | 1.21 | 0.47 | 0.30 | ○ | ○ | ○ |
| 3 | 1.22 | 0.48 | 0.30 | ○ | Δ | Δ |
| 4 | 1.22 | 0.45 | 0.30 | ○ | Δ | Δ |
| 5 | 1.20 | 0.53 | 0.34 | ○ | X | X |

TABLE 1-continued

| | Initial color density | Sliding property: Coefficient of static friction | Sliding property: Coefficient of dynamic friction | Anti-sticking | Retainability of recorded images: Anti-plasticizer | Retainability of recorded images: Oil resistance |
|---|---|---|---|---|---|---|
| 6 | 1.20 | 0.49 | 0.32 | ○ | X | X |
| 7 | 1.22 | 0.38 | 0.32 | ○ | ○ | ○ |
| 8 | 1.22 | 0.43 | 0.29 | ○ | ○ | ○ |
| 9 | 1.05 | 0.23 | 0.20 | X | X | X |
| 10 | 1.22 | 0.48 | 0.30 | X | ◎ | ◎ |

We claim:

1. A heat-sensitive record material comprising a protective layer on a recording layer wherein said recording layer is formed on a base sheet, said recording layer comprises a color forming material and a color developing material, and said color forming material is contacted with said color developing material upon heating said recording layer to produce color images, characterized in that said protective layer comprises a water-soluble polymer and a polyethylene wax having an average particle size of 3 to 10 μm, the polyethylene wax is present in an amount from 0.1 to 30 parts by weight per 100 parts by weight of a solid amount of said protective layer.

2. A heat-sensitive record material as defined in claim 1, wherein the polyethylene wax has an average particle size of 4 to 8 μm.

3. A heat-sensitive record material as defined in claim 1, wherein said polyethylene wax is present in an amount from 0.5 to 10 parts by weight per 100 parts by weight of a solid amount of said protective layer.

4. A heat sensitive record material as defined in claim 3, wherein said polyethylene wax is present in an amount from 0.5 to 5 parts by weight per 100 parts by weight of a solid amount of said protective layer.

* * * * *